US009085441B2

(12) United States Patent
Mullins

(10) Patent No.: US 9,085,441 B2
(45) Date of Patent: Jul. 21, 2015

(54) WALL RAISING APPARATUS

(71) Applicant: Solid Fabrications IP, LLC, Sims, NC (US)

(72) Inventor: Billy R. Mullins, Johnson City, TN (US)

(73) Assignee: Solid Fabrications IP LLC, Sims, NC (US)

( * ) Notice: Subject to any disclaimer, the term of this patent is extended or adjusted under 35 U.S.C. 154(b) by 88 days.

(21) Appl. No.: 13/891,730

(22) Filed: May 10, 2013

(65) Prior Publication Data

US 2013/0343833 A1 Dec. 26, 2013

Related U.S. Application Data

(60) Provisional application No. 61/688,309, filed on May 11, 2012.

(51) Int. Cl.

| | |
|---|---|
| ***B66C 23/68*** | (2006.01) |
| ***E04G 21/16*** | (2006.01) |
| ***E04G 21/26*** | (2006.01) |
| ***B66C 23/20*** | (2006.01) |

(52) U.S. Cl.

CPC ..... *B66C 23/68* (2013.01); *B66C 23/202* (2013.01); *E04G 21/168* (2013.01); *E04G 21/26* (2013.01)

(58) Field of Classification Search

USPC ..... 108/127, 129, 169, 190, 79; 135/114, 135/143, 153, 25.1, 25.3, 25.32, 25.4; 15/144.1, 144.3, 144.4, 203; 187/239, 187/254, 264, 266; 211/195; 212/280, 294, 212/295, 299, 306; 254/329, 332, 93 R; 343/874, 875, 881; 403/100, 347, 62; 414/10–12, 462; 52/117, 122.1, 127.2, 52/749.1, DIG. 1

See application file for complete search history.

(56) References Cited

U.S. PATENT DOCUMENTS

| | | | | | |
|---|---|---|---|---|---|
| 1,515,466 | A | * | 11/1924 | Dore | 135/114 |
| 1,645,885 | A | * | 10/1927 | Thompson | 403/100 |
| 1,714,698 | A | * | 5/1929 | Stoll | 403/100 |
| 2,812,077 | A | | 11/1957 | Proctor | |
| 3,000,683 | A | * | 9/1961 | Macneary | 312/235.3 |
| 3,485,386 | A | | 12/1969 | Miller | |
| 5,211,297 | A | * | 5/1993 | Vandervalk | 212/294 |
| 5,265,742 | A | * | 11/1993 | Stenger et al. | 212/179 |
| 5,775,655 | A | * | 7/1998 | Schmeets | 248/240 |
| 5,833,430 | A | | 11/1998 | Reynolds et al. | |
| 6,019,561 | A | | 2/2000 | Thomson et al. | |
| 6,082,945 | A | * | 7/2000 | Jeffries et al. | 414/11 |
| 6,202,868 | B1 | * | 3/2001 | Murray | 212/294 |
| 7,021,606 | B2 | * | 4/2006 | Raycraft | 254/329 |
| 7,448,598 | B1 | * | 11/2008 | Elmlinger et al. | 254/338 |
| 7,845,622 | B1 | * | 12/2010 | Riggs | 254/326 |
| 2007/0175174 | A1 | * | 8/2007 | Bruno | 52/745.12 |

* cited by examiner

*Primary Examiner* — Gregory Adams

(74) *Attorney, Agent, or Firm* — Myers Bigel Sibley & Sajovec, PA

(57) ABSTRACT

A wall jack includes a center elongated section, a lower elongated section having a distal end portion pivotally connected to a proximal end portion of the center section and an upper elongated section having a proximal end portion pivotally connected to a distal end portion of the center section. The wall jack is movable between an extended and collapsed position. In the extended position, the lower section is releasably locked to the proximal end portion of the center section and the upper section is releasably locked to the distal end portion of the center section such that the center, lower and upper sections form a longitudinally extending wall jack. In the collapsed position, the upper section is rotated in a first direction into the center section, and the lower section is rotated in a second direction that is opposite the first direction into the center section.

11 Claims, 2 Drawing Sheets

WALL RAISING APPARATUS

RELATED APPLICATIONS

This application claims priority to U.S. Provisional Application No. 61/688,309, filed May 11, 2012, the disclosure of which is incorporated herein in its entirety.

BACKGROUND

Wall raising devices (sometimes called "wall jacks") are used in the construction field, whereby after walls have been framed on the floor or deck, they are then lifted to the desired vertical placement allowing the wall to be secured to the floor.

Wall jacks of the past have been large, awkward to handle, sometimes quite heavy, and a majority of the time have required two people to handle. Various wall jack designs are described in U.S. Pat. Nos. 2,812,077, 3,485,386, 5,833,430 and 6,019,561, the disclosures which are incorporated by reference herein in their entireties.

U.S. Pat. No. 6,019,561 proposes a "collapsible" nylon strap-tubular design. However, the nylon straps do not feed out or retract as easily and freely as cable designs; moreover, the tubular design may not provide the sufficient strength characteristics without considerably more expense in materials. Cables can be affordable, durable and practical; and, therefore, nylon straps are rarely desirable. Further, U.S. Pat. No. 6,019,561 does not consider possible back strap-slap towards the user that may be possible with nylon material failure in heavier-wall erections.

Fabricated cylindrical shafts, such as those of U.S. Pat. Nos. 2,812,077, 3,485,386 and 6,019,561, may not provide the strength either longitudinally, transversely or cross-sectionally in comparison to that of square tubing or U- or C-channeled extensions. Being more prone to collapse, especially for use with higher walls of greater mass and weight, their construction must be of such material as to make them cost prohibitive, or otherwise present a greater hazard to the user. U.S. Pat. No. 5,833,430 proposes wood sections, which are also prone to strength and safety concerns during use.

SUMMARY

According to some embodiments, a wall jack comprises: a center elongated section, the center section having a U-shaped cross section forming a U-shaped channel; a lower elongated section, the lower section having a U-shaped cross section forming a U-shaped channel, the lower section having a distal end portion pivotally connected to a proximal end portion of the center section; and an upper elongated section having a proximal end portion pivotally connected to a distal end portion of the center section. The wall jack is movable between an extended position and a collapsed position. In the extended position, the lower section is releasably locked to the proximal end portion of the center section and the upper section is releasably locked to the distal end portion of the center section such that the center, lower and upper sections form a longitudinally extending wall jack. In the collapsed position, the upper section is rotated in a first direction into the U-shaped channel of the center section, and the lower section is rotated in a second direction that is opposite the first direction into the U-shaped channel of the center section such that the upper section resides at least partially in the U-shaped channel of the lower section.

The lower section may be releasably locked to the center section by a first removable pin and the upper section may be releasably locked to the center section by a second removable pin in the extended position, and the lower section may be releasably locked to the center section using at least one of the first and second removable pins in the collapsed position. In some embodiments, in the extended position: the lower section is releasably locked to the center section by the first removable pin that extends through the distal end portion of the lower section and at least a portion of the proximal end of the center section; and the upper section is releasably locked to the center section by the second removable pin that extends through the proximal end portion of the upper section and at least a portion of the distal end of the center section. The first removable pin may extend through aligned apertures at the proximal end portion of the center section and respective aligned apertures at the distal end portion of the lower section; and the second removable pin may extend through aligned apertures at the distal end portion of the center section and respective aligned apertures at the proximal end portion of the upper section.

In the collapsed position, the proximal end portion of the lower section may be releasably locked to the proximal end portion of the center section. In the collapsed position the lower section may be releasably locked to the center section by at least one of the first and second removable pins. The lower section may be releasably locked to the center section by the at least one removable pin that extends through the distal end portion of the lower section and at least a portion of the proximal end of the center section.

In some embodiments, the wall jack includes a foot member, the foot member adapted to be pivotally connected to the lower section proximal end portion in the extended position, the foot member adapted to be releasably locked to the center section in the collapsed position. The foot member may be pivotally connected to the lower section proximal end portion by a third removable pin in the extended position, and the foot member may be adapted to be releasably locked to the center section by at least one of the first, second and third removable pins in the collapsed position.

In some embodiments, the wall jack includes: a cable winding mechanism connected to the center section; and cable engaging the cable winding mechanism, the cable extending over the pulley and having a distal end with a wall engagement member. In the extended position: the foot member is adapted to be connected to a floor; the wall engagement member is adapted to engage with a top portion of a wall that is disposed on the floor; and the cable winding mechanism is adapted to wind the cable with the wall engagement member engaged with the wall, thereby lifting the top portion of the wall such that the wall assumes a substantially vertical orientation. The cable may be positioned within the U-shaped channel of the lower section and/or the U-shaped channel of the center section as the top portion of the wall is lifted.

DETAILED DESCRIPTION OF EMBODIMENTS OF THE INVENTION

Figure 1:
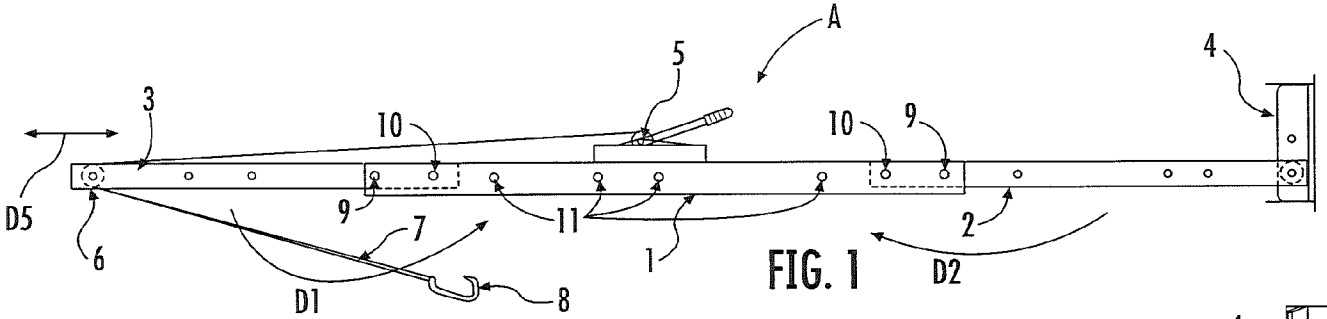
FIG. 1 is a side view of a wall raising apparatus in an extended position according to some embodiments.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the expression "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

Figure 2:
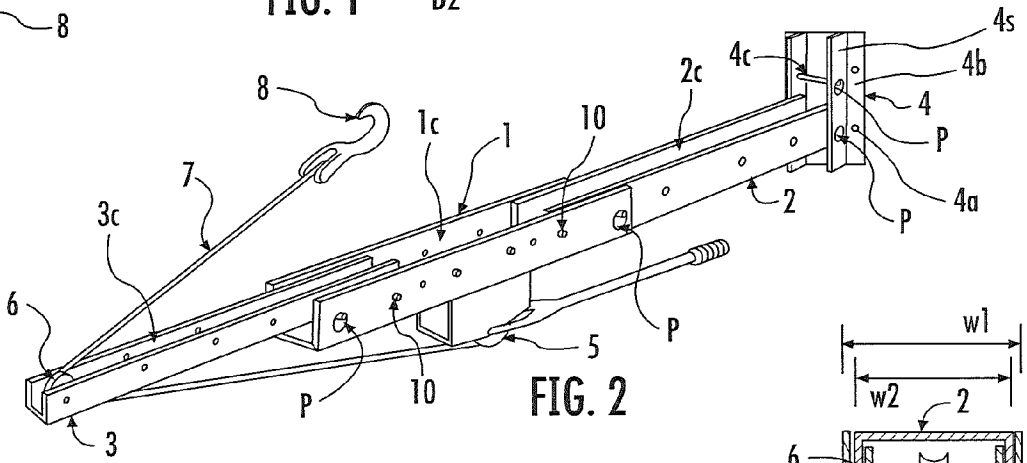
FIG. 2 is a perspective view of the wall raising apparatus of FIG. 1.

A wall raising apparatus or wall jack A according to some embodiments of the invention is shown in FIGS. 1-4. In FIG. 1 and FIG. 2, the apparatus A is shown folded out and extended into its extended or working position. In the extended position, the apparatus A is configured to lift a framed wall from the horizontal to full vertical, ready-to-install position, as will be described in greater detail below.

The apparatus A includes a center section 1, a lower section 2 and an upper section 3. The lower and upper sections 2, 3 are pivotally connected to the center section 1 by pivot members or pins 10 at opposite proximal and distal end portions of the center section 1. Adjacent each of the pivot members 10 are aligned apertures 9 on opposite sides of the center portion 1. As shown in FIG. 2, a removable member or pin P extends through the apertures 9 and corresponding aligned apertures of each of the lower and upper sections 2, 3 to lock the lower and upper sections 2, 3 in the extended position.

Also in the extended position, a foot member 4 may be pivotally connected to the lower section 2. As shown in FIG. 2, the foot member 4 includes a bottom wall 4*b* and a pair of side walls 4*s* that extend outwardly from the bottom wall 4*b*. Each one of the side walls 4*s* includes at least one aperture 12 aligned with an aperture 12 of the other one of the side walls 4*s*. As shown in FIG. 2, a removable member or pin P extends through the aligned apertures 12 and corresponding aligned apertures at a proximal end portion of the lower section 2 to pivotally connect the lower section 2 and the foot member 4.

A cable winding mechanism 5 (e.g., winch) is provided on the center section 1. The cable winding mechanism is configured to retain and wind cable 7 that is routed around a pulley 6 disposed at a distal end portion of the upper section 3. A wall attachment feature 8 (e.g., hook) is disposed at a distal end of the cable 7. The wall attachment feature 8 is configured to attach or secure to a portion of a wall to be raised, as described in more detail below. The cable winding mechanism 5 may be electrical or mechanical, and may be operated in any suitable manner to wind the cable 7 thereon for the lifting of a wall. The cable winding mechanism 5 may include a ratchet mechanism that inhibits unwinding of the cable 7, even under significant force.

As shown in FIG. 2, at least the center section 1 and the lower section 2 are C-shaped or U-shaped to form C-shaped or U-shaped channels 2*c*, 3*c*. As illustrated, the upper section 3 may be C-shaped or U-shaped to form a C-shaped or U-shaped channel 3*c*. Alternatively, the upper section 3 may be a hollow or solid member having a rectangular or square cross-section. After use, to prepare the apparatus A for transportation and/or storage, the apparatus A is manipulated to a collapsed position shown in FIGS. 3 and 4.

To manipulate to the collapsed position, the removable pins P are first removed to unlock the upper section 3 and lower section 2 and to remove the foot pad 4 from the center section 1. The upper section 3 is folded or rotated 180 degrees or about 180 degrees about the pivot member 10 in the direction shown by the arrow D1 into the center section channel 1*c* such that the distal end portion of the upper section 3 is disposed in the channel 1*c* at the proximal end portion of the center portion 1. The wall attachment feature or hook 8 may be fully retracted or nearly fully retracted and engaged with the distal end of the upper section 3 prior to folding or collapsing the upper section 3.

The lower section 2 is then folded or rotated 180 degrees or about 180 degrees about the pivot member 10 in the direction shown by the arrow D2 into the center section channel 1*c* such that the proximal end portion of the lower section 2 is disposed in the channel 1*c* at the distal end portion of the center portion 1.

Figure 4:
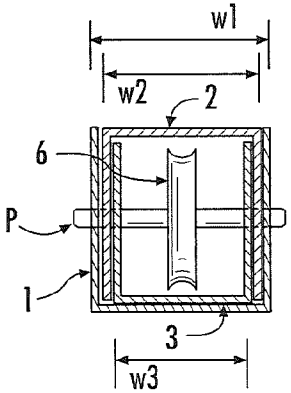
FIG. 4 is a sectional view of the wall raising apparatus of FIG. 3.

In the collapsed position, the lower section 2 is folded or rotated such that it resides above or over the folded or rotated upper section 3. As shown in FIG. 4, the center section 1 has a width W1, which is greater than a width W2 of the lower section 2, which in turn is greater than a width W3 of the upper section 3. The relative widths, along with the U-shaped configuration of the center section 1 and the lower section 2, allow the lower section 2 to be positioned in the center section channel 1*c* and to substantially surround the upper section 3, with the upper section 3 positioned in the lower section channel 2*c*.

The lower section 2 is then locked into place using one of the removable members or pins P. The lower section 2 includes a pair of aligned apertures that align with a pair of aligned apertures of the center section 1 when the lower section is rotated to the collapsed position. For example, the apertures that were previously aligned with the foot member apertures 12 may align with the apertures 9 at the distal end of the center section 1 and a removable member or pin P may be inserted therethrough to lock the apparatus A in the collapsed position. Alternatively, aligned apertures of the lower section may align with a pair of aligned apertures 11 of the center section 1, for example a pair of aligned apertures 11 adjacent the pivot member 10 at the proximal end portion of the center section 1. In some embodiments, in its collapsed position, the distal end of the upper section 3 does not extend to these aligned apertures 11, and therefore does not interfere with a removable member P as it is extended therethrough to lock the lower section 2, and therefore the apparatus A, in the collapsed position. As used herein, the term "aligned apertures" means aligned in the transverse direction, i.e., transverse from the lengthwise longitudinal direction (proximal to distal direction) of the sections 1, 2, 3. This is illustrated by the pin P extending in the transverse direction in FIG. 4.

Figure 3:
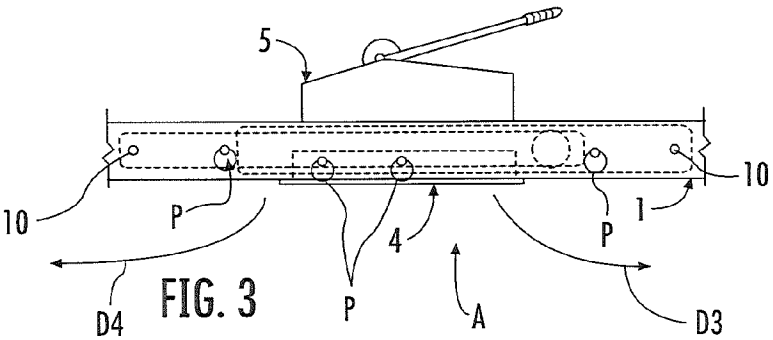
FIG. 3 is a side view of a portion of the wall raising apparatus of FIG. 1 in a collapsed position according to some embodiments.

The foot member 4 may also be attached to the center section 1 in the collapsed position. For example, and as illustrated in FIG. 3, apertures 12 of the foot member 4 may be aligned with center apertures 11 of the center section 1, and removable member(s) P may be inserted therethrough to lock the foot member 4 in place. Alternatively, aligned apertures 12 of the foot member 4 may be aligned with apertures 9 at the proximal or distal end portion of the center section, and a removable member P may be inserted therethrough to lock the foot member 4 to the center section 1.

Other configurations are contemplated. For example, the lower section 2 may have a rectangular or square cross-section and/or may have a width that is less than the width of the upper section 3 such that the upper section 3 resides above or over the lower section 2 in the collapsed position.

In its collapsed position or state, the apparatus A may be more easily carried and transported. When the apparatus A arrives at the next job site, the apparatus A may be manipulated to its extended position or state. Specifically, the removable pins 4 may be removed and the lower section 2 may be unfolded or rotated 180 degrees or about 180 degrees in the direction D3 (FIG. 3). The upper section 3 may be unfolded or rotated 180 degrees or about 180 degrees in the direction D4. The removable members or pins P may then be used to lock the lower and upper sections 2, 3 in the extended position, as described above.

Figure 5A:
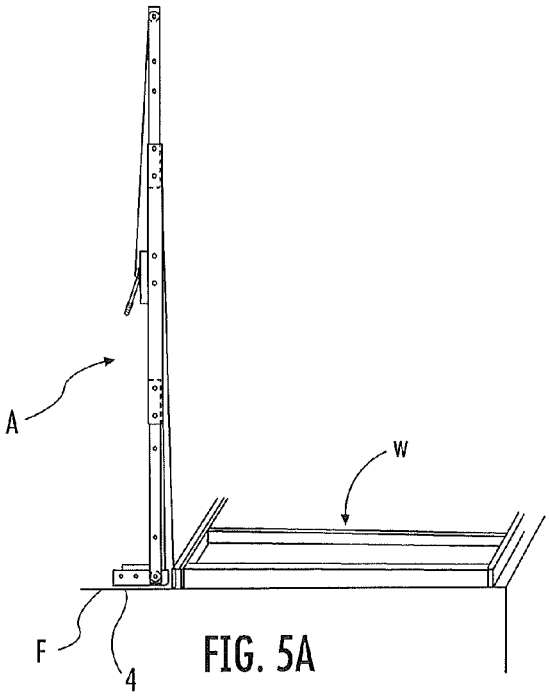
FIGS. 5A-5C illustrate exemplary operations of the wall raising apparatus of FIG. 1.
Figure 5B:
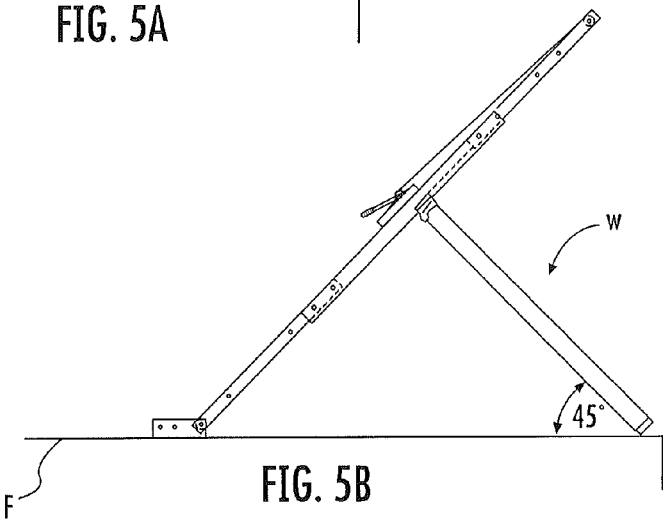
Figure 5C:
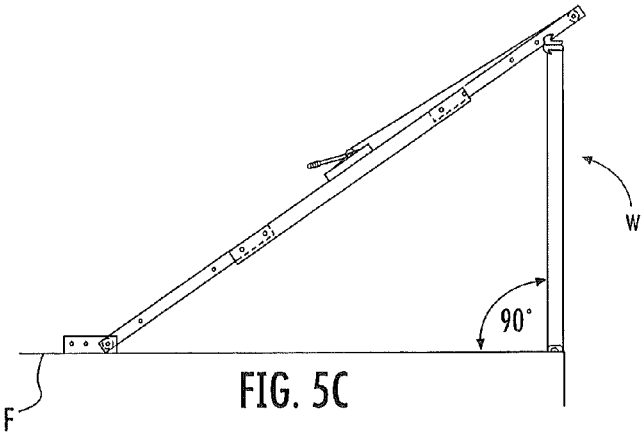

In its extended position or state, and as illustrated in FIGS. 5A-5C, the apparatus A may be operated generally as follows. The foot member 4 may be fastened to a floor F, for example, using fasteners or nails through apertures 4*a* (FIG. 2). The extended (locked) center, lower and upper section 1, 2, 3 are disposed in a generally vertical position. The cable 7 is extended over the pulley 6 and the hook 8 is attached to the "top" end portion of a wall or wall section W (i.e., the end of the wall that is to be lifted). In some embodiments, the upper section 3 and/or the pulley 6 may be configured such that the pulley may translate in the direction D5 (FIG. 1). That is, the pulley 6 may move toward and, in some embodiments, past the distal end of the upper section 3. This may allow the cable 7 to smoothly engage the pulley 6 with minimal or no interference from other components such as the upper section 3.

The cable winding mechanism 5 is actuated to cause the cable 7 to be wound thereonto. As the cable 7 is wound, the wall W is tipped up, pivoting on its "bottom" end portion, as shown in FIG. 5B. As the wall W swings upwardly, the apparatus A will lean toward it accordingly, maintaining contact with the top end portion of the wall W, until the wall W assumes a vertical or generally vertical orientation, as shown in FIG. 5C. At this point, the apparatus A may serve as a brace until the wall W is properly secured. In some embodiments, the pulley 6 serves as a catch or stop mechanism; that is, the pulley 6 may be positioned and configured to engage the top end portion of the wall W when the wall W is in the vertical or substantially vertical orientation, and thereby inhibit the wall W from tipping past vertical.

The cable 7 may extend through the U-shaped channels of at least the center and lower sections 1, 2 as the wall W is moved toward the vertical position as described above. In this regard, the U-shaped channels may serve as a safety mechanism by, for example, shielding an operator on the opposite side of the apparatus A were the cable 7 to break or snap during operation.

Therefore, embodiments of the invention can provide a safer, labor-saving "wall jack," which may be economical to produce and easily transported, as well as conveniently stored in any type vehicle typically used in construction. Apparatus according to embodiments of the invention may be convenient, facilitate ease of storing and/or the affordability and flexibility of use provided by the cabled, c-channeled, folded-up-and-out, relatively light-weight but strong design, which can be varied to accommodate a range of wall heights, weights and design characteristics.

Embodiments of the invention may allow one person to carry, unfold and use for the wall jack for the purpose of lifting walls, then fold it up for ease of portability and storability in most vehicles used by those in the construction field. In the folded-up position, this invention may measure as little as five feet in length, and be under four, five or six inches wide and twelve inches high, enabling it to be transported in virtually every truck and most cars.

The center, lower and upper sections 1, 2, 3 may be made of any suitable material; an exemplary suitable material is aluminum to reduce weight. Due in part to the C- or U-shaped channels, the apparatus may weigh less than 50 pounds, less than 75 pounds and less than 100 pounds in various embodiments. For larger-wall models, the apparatus may be fitted with removable wheels to facilitate transport to and from the construction site. The apparatus can be economically made at a machine shop, and equipped with hardware (e.g., winches, cranks, pulleys, cables, wheels, etc.) and packaged in a convenient weather-proof cover-bag.

As discussed above, unfolding the apparatus according to embodiments of the invention into a functional wall jack may be as simple as removing a plurality of pins (e.g., three or four pins), pivoting components 180 degrees, and reinserting the removed pins. Furthermore, embodiments of the invention may provide for variable strength cable and hook mechanisms to accommodate different wall materials, fabrications and weights. This cable may retract within rather than outside the C-channeled or U-channeled extension as the wall is raised, providing safety to the user by eliminating or reducing any possible slippage of the cable over the pulley at the end of the upper arm, or breakage as noted above. A variety of cable designs, materials and tensile strengths may be employed to accommodate varying loads without twisting, fraying or failure.

Many alterations and modifications may be made by those having ordinary skill in the art, given the benefit of present disclosure, without departing from the spirit and scope of the invention. Therefore, it must be understood that the illustrated embodiments have been set forth only for the purposes of example, and that it should not be taken as limiting the invention as defined by the following claims. The following claims, therefore, are to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the invention.

That which is claimed is:

1. A wall jack comprising:

a center elongated section, the center section having a U-shaped cross section forming a U-shaped channel;

a lower elongated section, the lower section having a U-shaped cross section forming a U-shaped channel, the lower section having a distal end portion pivotally connected to a proximal end portion of the center section; and an upper elongated section having a proximal end portion pivotally connected to a distal end portion of the center section;

a foot member;

a pulley connected to a distal end portion of the upper section;

a cable winding mechanism connected to the center section;

cable engaging the cable winding mechanism, the cable extending over the pulley and having a distal end with a wall engagement member;

wherein the wall jack is movable between an extended and collapsed position, wherein:

in the extended position, the lower section is releasably locked to the proximal end portion of the center section by a first removable pin and the upper section is releasably locked to the distal end portion of the center section by a second removable pin such that the center, lower and upper sections form a longitudinally extending wall jack, the foot member is pivotally connected to the proximal end portion of the lower section by a third removable pin, the foot member is adapted to be connected to a floor, the wall engagement member is adapted to engage with a top portion of a wall that is disposed on the floor, the cable winding mechanism is adapted to wind the cable with the wall engagement member engaged with the wall, thereby lifting the top portion of the wall such that the wall is lifted from a substantially horizontal orientation to a substantially vertical orientation, and the cable is positioned within the U-shaped channel of the lower section and/or the U-shaped channel of the center section as the top portion of the wall is lifted; and in the collapsed position, the upper section is rotated in a first direction into the U-shaped channel of the center section, and the lower section is rotated in a second direction that is opposite the first direction into the U-shaped channel of the center section such that the upper section resides at least partially in the U-shaped channel of the lower section, and the lower section is releasably locked to the center section using at least one of the first and second removable pins.

2. The wall jack of claim 1, wherein, in the extended position:

the lower section is releasably locked to the center section by the first removable pin that extends through the distal end portion of the lower section and at least a portion of the proximal end of the center section; and the upper section is releasably locked to the center section by the second removable pin that extends through the proximal end portion of the upper section and at least a portion of the distal end of the center section.

3. The wall jack of claim 2, wherein:

the first removable pin extends through aligned apertures at the proximal end portion of the center section and respective aligned apertures at the distal end portion of the lower section; and the second removable pin extends through aligned apertures at the distal end portion of the center section and respective aligned apertures at the proximal end portion of the upper section.

4. The wall jack of claim 2, wherein, in the collapsed position, the proximal end portion of the lower section is releasably locked to the proximal end portion of the center section.

5. The wall jack of claim 1, wherein the lower section is releasably locked to the center section by the at least one removable pin that extends through the distal end portion of the lower section and at least a portion of the proximal end portion of the center section.

6. The wall jack of claim 1, wherein the foot member is adapted to be releasably locked to the center section in the collapsed position.

7. The wall jack of claim 6, wherein the foot member is adapted to be releasably locked to the center section by at least one of the first, second and third removable pins in the collapsed position.

8. The wall jack of claim 1, wherein the upper section has a U-shaped cross section forming a U-shaped channel.

9. The wall jack of claim 8, wherein the pulley is configured to translate in the U-shaped channel of the upper section to a distal end of the upper section.

10. A wall jack comprising:

a center elongated section, the center section having a U-shaped cross section forming a U-shaped channel;

a lower elongated section, the lower section having a U-shaped cross section forming a U-shaped channel, the lower section having a distal end portion pivotally connected to a proximal end portion of the center section; and an upper elongated section having a proximal end portion pivotally connected to a distal end portion of the center section;

a foot member;

a pulley connected to the upper section;

a cable winding mechanism connected to the center section;

cable engaging the cable winding mechanism, the cable extending over the pulley and having a distal end with a wall engagement member;

wherein the wall jack is movable between an extended and collapsed position, wherein:

in the extended position, the lower section is releasably locked to the proximal end portion of the center section by a first removable pin that extends through aligned apertures at the distal end portion of the lower section and the proximal end of the center section and the upper section is releasably locked to the distal end portion of the center section by a second removable pin that extends through aligned apertures at the proximal end portion of the upper section and the distal end of the center section such that the center, lower and upper sections form a longitudinally extending wall jack, the foot member is pivotally connected to the lower section proximal end portion by a third removable pin, the foot member is adapted to be connected to a floor, the wall engagement member is adapted to engage with a top portion of a wall that is disposed on the floor, and the cable winding mechanism is adapted to wind the cable with the wall engagement member engaged with the wall, thereby lifting the top portion of the wall such that the wall assumes a substantially vertical orientation; and in the collapsed position, the upper section is rotated in a first direction into the U-shaped channel of the center section, and the lower section is rotated in a second direction that is opposite the first direction into the U-shaped channel of the center section such that the upper section resides at least partially in the U-shaped channel of the lower section, the lower section is locked to the center section by at least one of the first and second removable pins with the first or second removable pin extending through the distal end portion of the lower section and at least a portion of the proximal end portion of the center section, and the foot member is adapted to be releasably locked to the center section by at least one of the first, second and third removable pins.

11. The wall jack of claim 10, wherein the cable is positioned within the U-shaped channel of the lower section and/or the U-shaped channel of the center section as the top portion of the wall is lifted.

* * * * *